US006220992B1

(12) United States Patent
Shafik

(10) Patent No.: US 6,220,992 B1
(45) Date of Patent: Apr. 24, 2001

(54) BOXING EXERCISE APPARATUS

(76) Inventor: Aasef M. Shafik, 3409 Holly Rd., Annandale, VA (US) 22003-1264

( * ) Notice: Subject to any disclaimer, the term of this patent is extended or adjusted under 35 U.S.C. 154(b) by 0 days.

(21) Appl. No.: 09/382,114

(22) Filed: Aug. 24, 1999

(51) Int. Cl.[7] ..... A63B 21/00

(52) U.S. Cl. ..... 482/83; 482/106; 482/70; 482/104

(58) Field of Search ..... 482/104, 908, 482/669, 83, 87, 904

(56) References Cited

U.S. PATENT DOCUMENTS

| | | | | |
|---|---|---|---|---|
| 547,342 | | 10/1895 | Foster . | |
| 775,653 | | 11/1904 | Held . | |
| 1,177,473 | | 3/1916 | Bathrick . | |
| 1,242,626 | | 10/1917 | Wilson . | |
| 1,928,089 | | 9/1933 | Blickman . | |
| 2,315,485 | | 4/1943 | Jones . | |
| 2,625,356 | | 1/1953 | Kennedy . | |
| 2,642,287 | | 6/1953 | Rubin . | |
| 3,030,109 | | 4/1962 | Albitz . | |
| 3,332,683 | | 7/1967 | Rand . | |
| 3,411,497 | * | 11/1968 | Rickey et al. | 482/83 |
| 3,510,131 | | 5/1970 | Gardner . | |
| 4,216,957 | | 8/1980 | Curatola . | |
| 4,482,150 | | 11/1984 | Levine . | |
| 4,569,401 | | 2/1986 | Luck . | |
| 5,050,866 | | 9/1991 | Fucci . | |
| 5,286,241 | * | 2/1994 | Petrakis | 482/87 |
| 5,352,170 | | 10/1994 | Condo et al. . | |
| 5,460,343 | | 10/1995 | Hestilow . | |
| 5,554,088 | | 9/1996 | Zlojutro . | |
| 5,582,561 | | 12/1996 | Gonzalez . | |
| 5,674,157 | | 10/1997 | Wilkinson . | |
| 5,839,995 | * | 11/1998 | Chen | 482/92 |
| 5,863,278 | | 1/1999 | Chen . | |

* cited by examiner

*Primary Examiner*—Jerome W. Donnelly
(74) *Attorney, Agent, or Firm*—Dennis H. Lambert

(57) ABSTRACT

Boxing exercise apparatus has an adjustable frame that can selectively adjustably support different types of punching bags in optimum position to be struck with the hands and/or feet of a person or persons using the apparatus. In particular, the frame is releasably attachable to a conventional treadmill for simultaneous use of the boxing exercise apparatus and the treadmill. In one form of the invention, the frame is capable of being free-standing independently of use with a treadmill, and in another form the frame relies upon its attachment to a treadmill to support it in an operative upright position.

20 Claims, 5 Drawing Sheets

FIG. 5
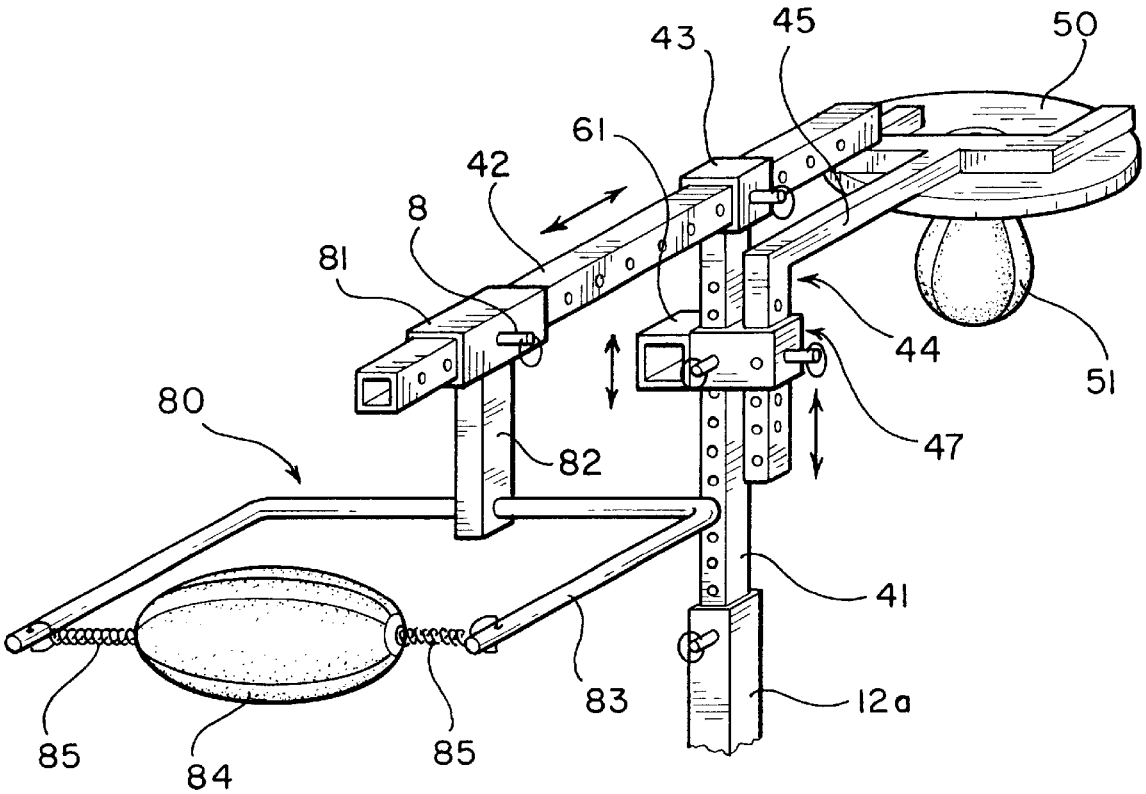
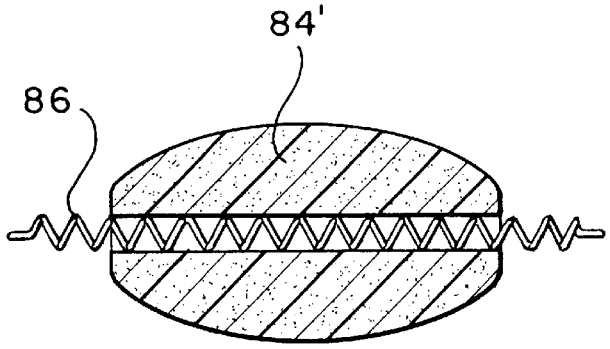
FIG. 6

BOXING EXERCISE APPARATUS

BACKGROUND OF THE INVENTION

1. Field of the Invention

This invention relates generally to exercise equipment. More specifically, the invention relates to boxing exercise apparatus with multiple, independently adjustable exercise devices, including at least one object to be struck with the hands and/or feet, and means to attach the apparatus to a treadmill.

2. Prior Art

The benefits of exercise are universally recognized. However, because of changes in the workplace and home environments, people do not obtain enough exercise in connection with their normal daily activities. Consequently, myriad exercise equipment has been devised to meet the demand for convenient and effective devices and machines that enable these benefits to be realized.

Many people join health clubs or other facilities which offer a variety of exercise equipment and programs, while other people install exercise equipment in their homes or places of work. Primarily because of space limitations, it is particularly desirable that equipment installed in the home be capable of providing exercise for more than one muscle group. However, much of the available exercise equipment is designed for a single exercise, e.g., treadmills and stair-steppers are designed for exercising the legs. Other equipment, most notably that which simulates cross-country skiing, does provide for the simultaneous exercise of multiple muscle groups, but the range or type of exercises possible with such equipment is limited.

Examples of exercise equipment which has means for multiple exercises are described in U.S. Pat. Nos. 1,928,089, 2,315,485, 3,332,683, 3,411,497, 4,569,401, 5,582,561, and 5,674,157. Some of these patents, i.e., U.S. Pat. No. 4,569, 401, 5,582,561 and 5,674,157, disclose apparatus which enables simultaneous exercise of the legs and upper body or arms, and include pads or bags which may be struck with the hands and/or feet. U.S. Pat. No. 5,582,561 further discloses an apparatus which includes a treadmill and a punching device, in which the treadmill is carried by a rotatable platform, and in which the rotatable platform and treadmill are independently motor driven. The punching device may be adjusted for height and toward and away from the platform. The remaining patents generally permit only a single exercise at a time, but some of them, i.e., U.S. Pat. Nos. 1,928,089 and 3,411,497, can be adjusted to permit different exercises to be performed. U.S. Pat. Nos. 2,31 5,485 and 3,332,683 disclose apparatus which includes a treadmill and resistance pads against which a person using the device pushes to obtain greater intensity of exercise of the legs.

Other U.S. Pat. Nos., e.g., 5,352,170 and 5,863,278, disclose boxing training devices which incorporate more than one punching bag or pad at different stations in the device, and in U.S. Pat. No. 5,352,170 at least some of the bags or pads are adjustable to different positions.

None of the prior art devices combines a boxing exercise device with a conventional treadmill, particularly with multiple punching devices which may be independently adjusted to plural positions for selective use, or which permits different types of punching devices to be substituted. In particular, none of the prior art devices has any means for supporting the apparatus on a conventional treadmill and for adjustably supporting a punching device in position to be used simultaneously with use of the treadmill.

SUMMARY OF THE INVENTION

The present invention provides an exercise apparatus which combines a treadmill with multiple punching devices that may be independently adjusted to plural positions, and which permits different types of punching devices to be substituted for selective use.

The invention further includes a punching device which may be supported on a conventional treadmill in position to be used simultaneously with use of the treadmill.

A first form of exercise apparatus according to the invention comprises a free-standing assembly that includes a frame having means for supporting it on a surface, adjustable means for adjustably supporting multiple punching devices for selective or simultaneous use, and means for attaching the apparatus to a conventional treadmill for simultaneous use of the punching device or devices and the treadmill. The multiple punching devices are of different types, including a heavy bag, a speed bag, and various padded members for performing different types of striking exercises.

A second form of exercise apparatus according to the invention comprises an assembly that is mounted on and supported from the hand rails or uprights of a conventional treadmill, and includes a frame that supports a punching device in position to be used simultaneously with use of the treadmill. Different types of punching device may be substituted to permit different striking exercises to be performed, and the punching device is both vertically and horizontally adjustable relative to the treadmill.

The frame in both forms of the invention may be made of metal or other suitable material, and may be of any suitable cross-section, including square-section tubing and/or round-section tubing. Further, different types of punching devices and treadmills other than those specifically shown herein may be used.

BRIEF DESCRIPTION OF THE DRAWINGS

The foregoing, as well as other objects and advantages of the invention, will become apparent from the following detailed description when considered in conjunction with the accompanying drawings, wherein like references characters designate like parts throughout the several views, and wherein:

FIG. 5 is a fragmentary perspective view of a portion of the apparatus of FIG. 1, showing a different type of punching device in position to be struck by a person using the device and using a treadmill, and showing a second punching device adjusted to a different position than shown in FIG. 1;

FIG. 6 is an enlarged fragmentary longitudinal sectional view of the punching device of FIG. 5;

DETAILED DESCRIPTION OF THE PREFERRED EMBODIMENTS

Figure 1:
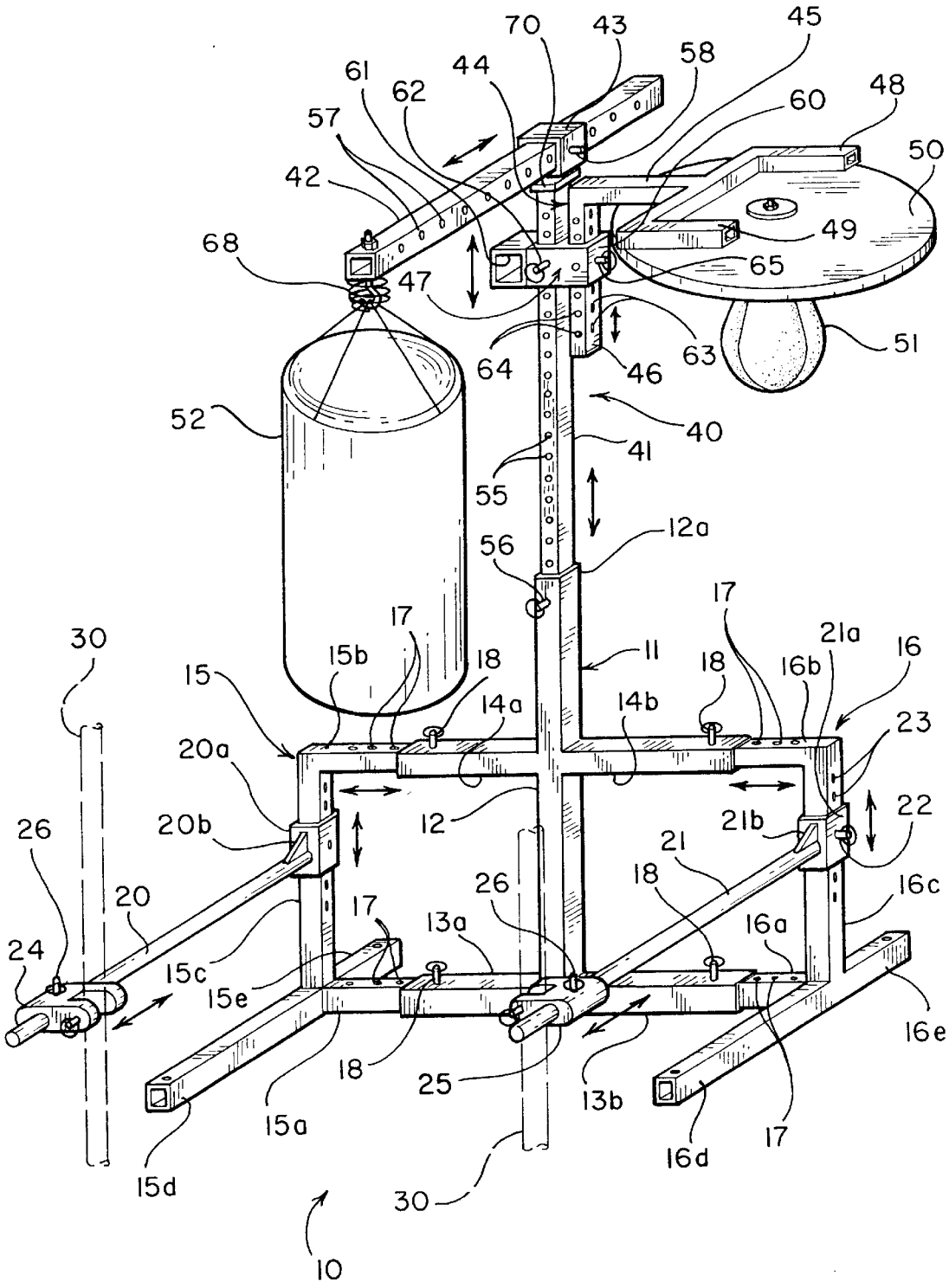
FIG. 1 is a front perspective view of a first form of apparatus according to the invention.
Figure 4:
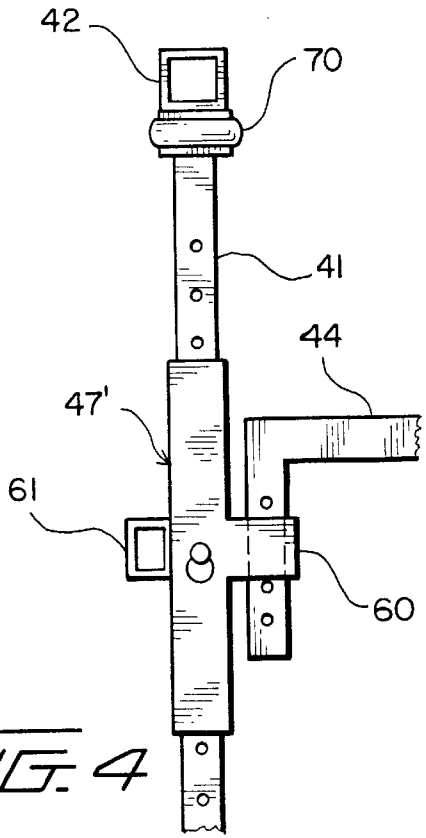
FIG. 4 is an enlarged fragmentary view in elevation of an upper portion of the frame of FIG. 1, showing an alternate construction of the multi-purpose bracket, wherein a larger support area is provided.
Figure 3:
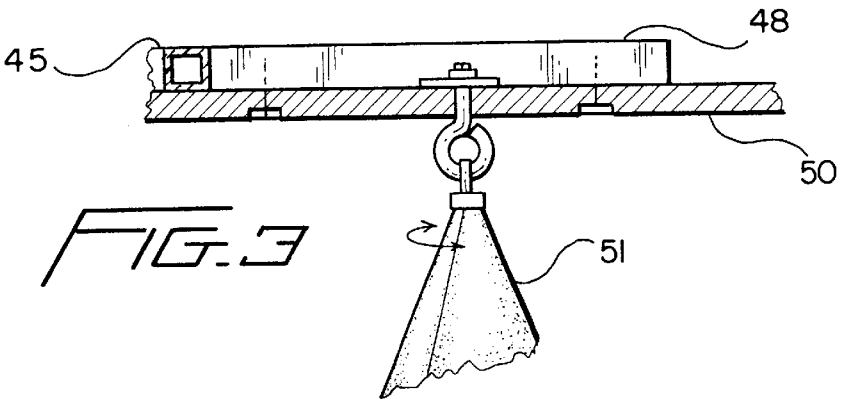
FIG. 3 is an enlarged fragmentary sectional view of the speedbag and its support.
Figure 2:
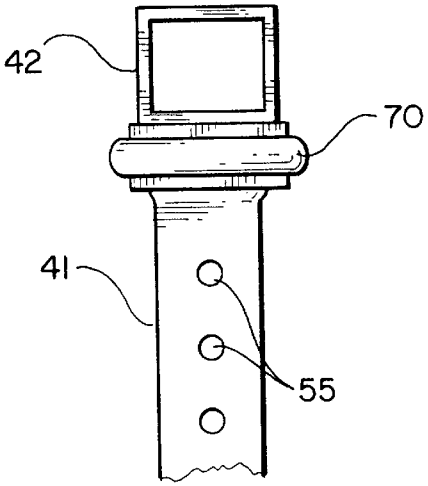
FIG. 2 is an enlarged fragmentary view in elevation of an upper portion of the frame of FIG. 1, showing the shock absorber used between the vertical and horizontal components of the frame.

Referring more specifically to the drawings, a first form of exercise apparatus according to the invention is indicated generally at 10 in FIG. 1. In this form of the invention the apparatus is free-standing and comprises a frame having a frame base with a central section 11 defined by a vertical center spar 12 and oppositely extending pairs of cross arms 13*a,* 13*b* and 14*a,* 14*b*. The first pair of cross arms 13*a,* 13*b* extend in opposite directions from the lower end of the spar 12, and the second pair 14*a,* 14*b* extend in opposite directions from the spar spaced from its upper end, defining an upward extension 12*a*.

Adjustable opposite side frame assemblies 15 and 16 have horizontal, vertically spaced parallel arms 15*a,* 15*b* and 16*a,* 16*b,* respectively, telescopically engaged in the arms 13*a,* 14*a* and 13*b,* 14*b,* respectively. The arms 15*a* and 15*b* are at the bottom and top ends, respectively, of vertical member 15*c;* and the arms 16*a* and 16*b* are at the bottom and top ends, respectively, of vertical member 16*c*. Fore and aft extending horizontal supports 15*d* and 15*e* project in opposite directions from the bottom end of vertical member 15*c,* and similar fore and aft extending horizontal supports 16*d* and 16*e* project in opposite directions from the bottom end of vertical member 16*c*.

The arms 13*a,* 13*b,* 15*a,* 16*a* and supports 15*d,* 15*e,* 16*d,* 16*e* are coplanar with one another and define a structure to support the frame on a surface, such as a floor. If desired, suitable fasteners, not shown, may be extended through the outer free ends of the supports 15*d,* 15*e,* 16*d,* 16*e* to secure the frame to a floor or other surface.

Each of the arms 15*a,* 15*b* and 16*a,* 16*b* has a plurality of uniformly spaced apertures 17 therein, and pins 18 are extended through openings in the outer ends of arms 13*a,* 14*a* and 13*b,* 14*b,* respectively, and into aligned apertures 17 to hold the side frame assemblies 15 and 16 in adjusted positions relative to the center frame 11.

A pair of attaching arms 20 and 21 extend forwardly from brackets 20*a* and 21*a,* respectively, vertically adjustable on members 15*c* and 16*c,* and secured in vertically adjusted position by pins 22 extended through an opening in the bracket and into an aligned aperture 23 in the members 15*c,* 16*c,* respectively. The connections of the arms 20 and 21 with their respective brackets 20*a* and 21*a* are reinforced by gussets 20*b* and 21*b,* respectively.

Clamps 24 and 25 are adjustable along the arms 20 and 21, and may be secured in adjusted position by set screws 26 extended through the clamps and into engagement with the arms. The clamps are adapted to be secured on uprights 30 of a conventional treadmill to attach the frame in predetermined spaced relationship to the treadmill (not shown).

The frame also includes a frame superstructure 40 having a vertical member 41 telescopically adjustably engaged in the projection 12*a* of the frame base, a horizontal support arm 42 adjustably carried in a bracket sleeve 43 mounted on the upper end of the vertical member, and a generally L-shaped accessory member 44 with a horizontal component 45 and a vertical component 46 adjustably carried in a multi-purpose bracket 47 that is vertically adjustable on the vertical member 41. The horizontal component 45 has a bifurcated end 48, 49 that mounts a circular board 50, from which is suspended a speed bag 51.

In the embodiment shown in FIG. 1, the L-shaped accessory member 44 is oriented so that the horizontal component 45 extends to the side relative to the frame, and a heavy bag 52 is supported at the outer or forward end of arm 42 in a position to be accessible from a treadmill (not shown) attached to the frame by arms 20 and 21.

The vertical member 41 has a plurality of uniformly spaced apertures 55 therein for cooperation with a pin 56 extended through an opening in the upper end of extension 12*a* to secure the frame superstructure in vertically adjusted position.

Similarly, the horizontal support arm 42 has a plurality of apertures 57 therein for cooperation with a pin 58 extended through an opening in the bracket 43 and into an aligned aperture to secure the arm in a horizontally adjusted position.

Figure 7:
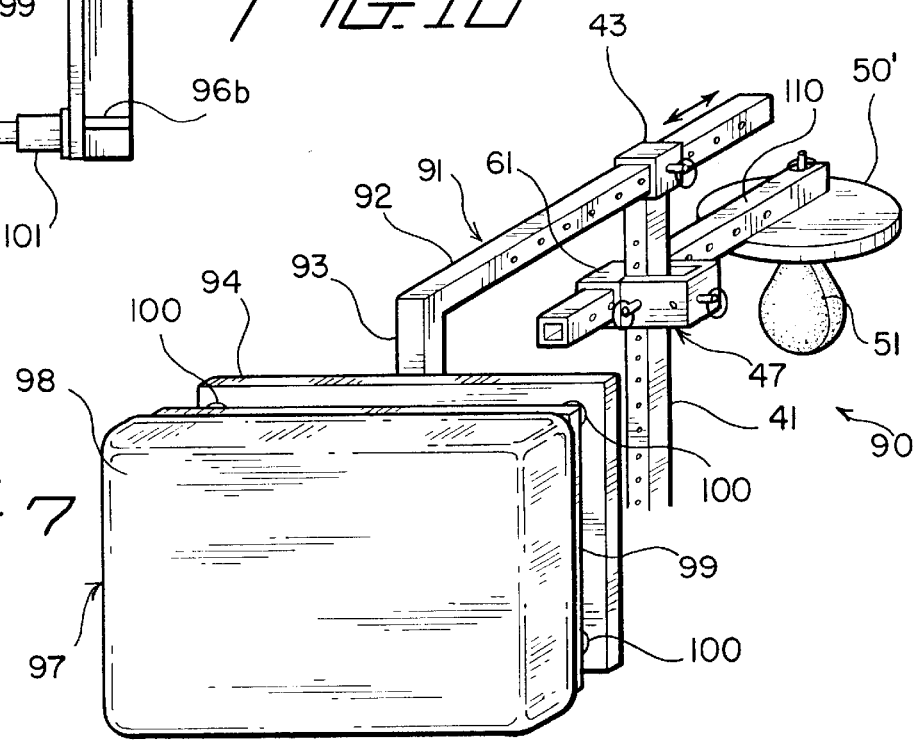
FIG. 7 is a fragmentary perspective view similar to FIG. 5, showing a different type of punching device in position to be struck by a person using the punching device and a treadmill.
Figure 13:
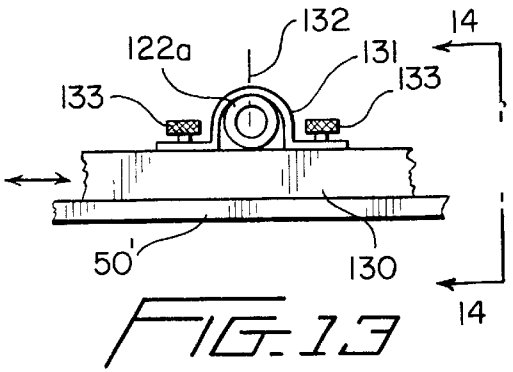
FIG. 13 is a slightly enlarged fragmentary view in section taken along line 13—13 in FIG. 12.
Figure 12:
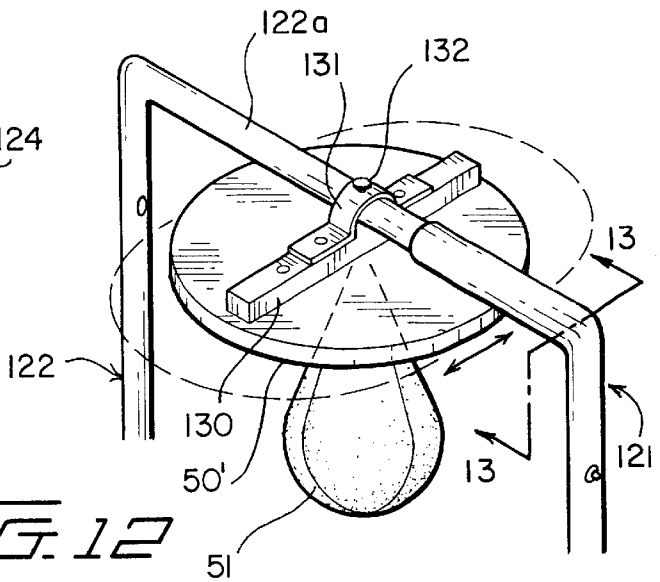
FIG. 12 is a slightly enlarged fragmentary top perspective view of an alternate type of punching device for use in the apparatus of FIG. 11.
Figure 14:
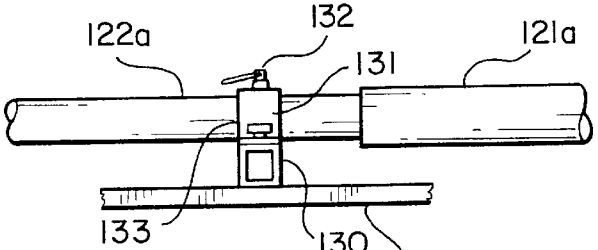
FIG. 14 is a fragmentary view taken along line 14—14 in FIG. 13.

The multi-purpose bracket 47 has a first section 60 defining a vertically oriented sleeve for vertical sliding reception of the vertical component 46 of the L-shaped accessory member 44, and a second section 61 defining a horizontally oriented sleeve for horizontal reception of additional components (see FIG. 7, for example). The bracket 47 is secured in vertically adjusted position on the member 41 by engagement of pin 62 in one of the apertures 55.

The vertical component 46 of L-shaped accessory member 44 has uniformly spaced apertures 63 and 64 in at least two of its adjacent sides for cooperation with a pin 65 that may be extended through respective openings in two orthogonally related sides of the section 60 of the bracket 47 to secure the accessory member 44 in different orientations as well as in different vertically adjusted positions. Two of the different orientations are shown in FIGS. 1 and 5, where the accessory member 44 is shown in FIG. 1 as extending to the side of the frame, and in FIG. 5 as extending to the rear of the frame.

In order to relieve stresses imposed on the system by striking the punching devices, particularly the heavy bag 52, a resilient connection such as a spring or the like 68 may be interposed between the punching device and its connection with the support arm 42. Further, the support arm is preferably mounted to the vertical member 41 through a resilient connection 70 which has a structure and function similar to that of an engine mount, which permits limited relative movement in all directions between the arm 42 and the member 41.

An alternative arrangement is shown in FIG. 5, wherein a different style of punching device 80 is assembled to the frame. In this embodiment, the heavy bag 52 and its mounting hardware are removed from the arm 42, and T-shaped bracket 81 is telescopically engaged on the arm in its place. The bracket 81 has a depending leg 82 with a U-shaped mounting arm 83 fixed to its lower end and extending-forwardly therefrom. An elongate, generally melon-shaped punching bag 84 is suspended between the ends of the mounting arm 83, preferably by a resilient connection such as springs or the like 85.

As depicted in FIG. 6, the bag 84' can be hollow and the spring 86 can extend through the bag for connection at its opposite ends with the ends of the arm 83.

In all other respects, the forms of the invention shown in FIGS. 5 and 6 are intended to function in the same way as the form of the invention previously described.

Figure 9:
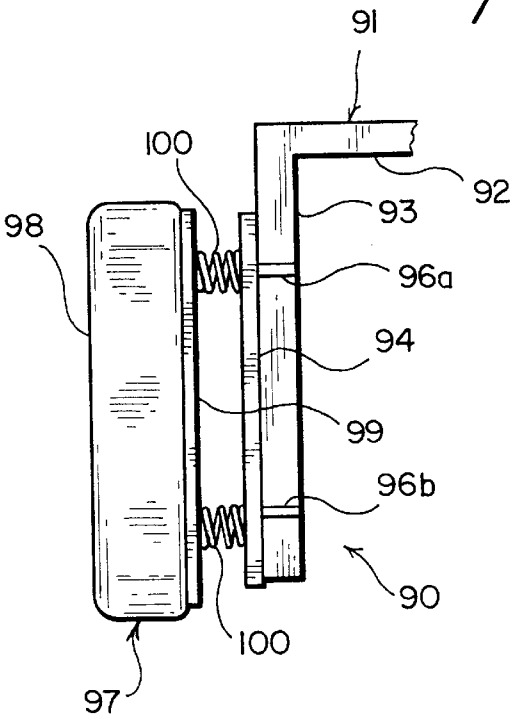
FIG. 9 is a side view in elevation of the punching device of FIG. 7, looking in the direction of the arrows 9—9.
Figure 8:
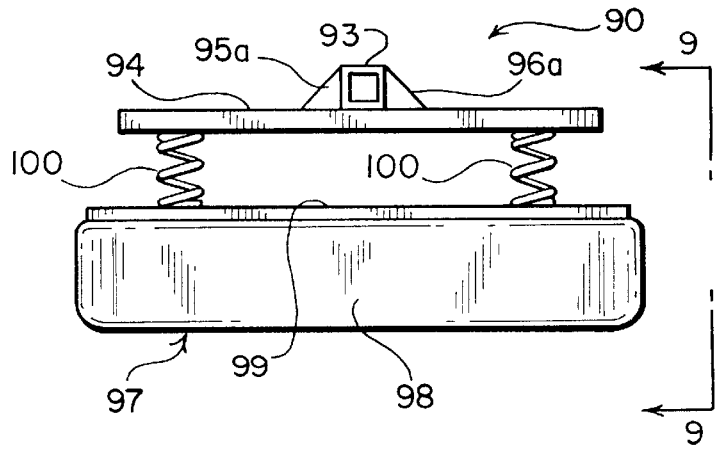
FIG. 8 is a top plan view of the punching device of FIG. 7.

A further embodiment of the invention is indicated generally at 90 in FIGS. 7–9. In this embodiment, the arm 42 is removed from the bracket 43 and an L-shaped arm 91 inserted in its place. The arm 91 includes a horizontal component 92 telescopically engaged in the bracket 43, and a depending leg 93 to which is mounted a backing board 94. Attachment of the backing board to the leg is reinforced by pairs of gussets 95*a,* 96*a* and 95*b,* 96*b.* A generally pillow-shaped punching bag 97 comprising a pad 98 and backing member 99 is mounted to the backing board 94 by resilient mounting means, which may comprise a plurality of spaced springs 100 connected between the backing board and the backing member.

Figure 10:
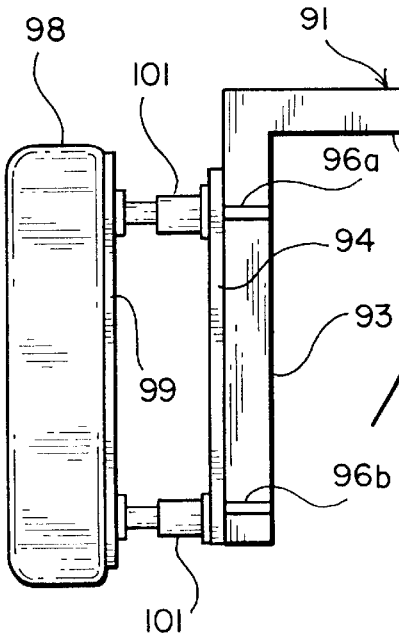
FIG. 10 is a side view in elevation similar to FIG. 9, showing an alternate form of shock absorber means for the punching device.

Alternatively, the springs 100 may be replaced with shock absorbers 101, as depicted in FIG. 10, for example.

Further, as shown in FIG. 7, the L-shaped arm 44 and its attached board 50 may be removed from the bracket 47 and a straight arm 110 inserted through sleeve 61. As shown in this figure, the arm 110 extends rearwardly of the frame, but it could extend forwardly, if desired, upon removal of the arm 91 and punching bag 97. A circular board 50' is mounted to the outer end of the arm 110, and a speed bag 51 is suspended therefrom.

A simplified version of the invention is indicated generally at 120 in FIGS. 11–14. In this form of the invention, a pair of L-shaped members 121 and 122 have relatively short horizontal legs 121*a* and 122*a,* respectively, and relatively longer depending legs 121*b* and 122*b,* respectively. The horizontal legs are telescopically interengaged with one another to form an inverted U-shaped frame.

Figure 11:
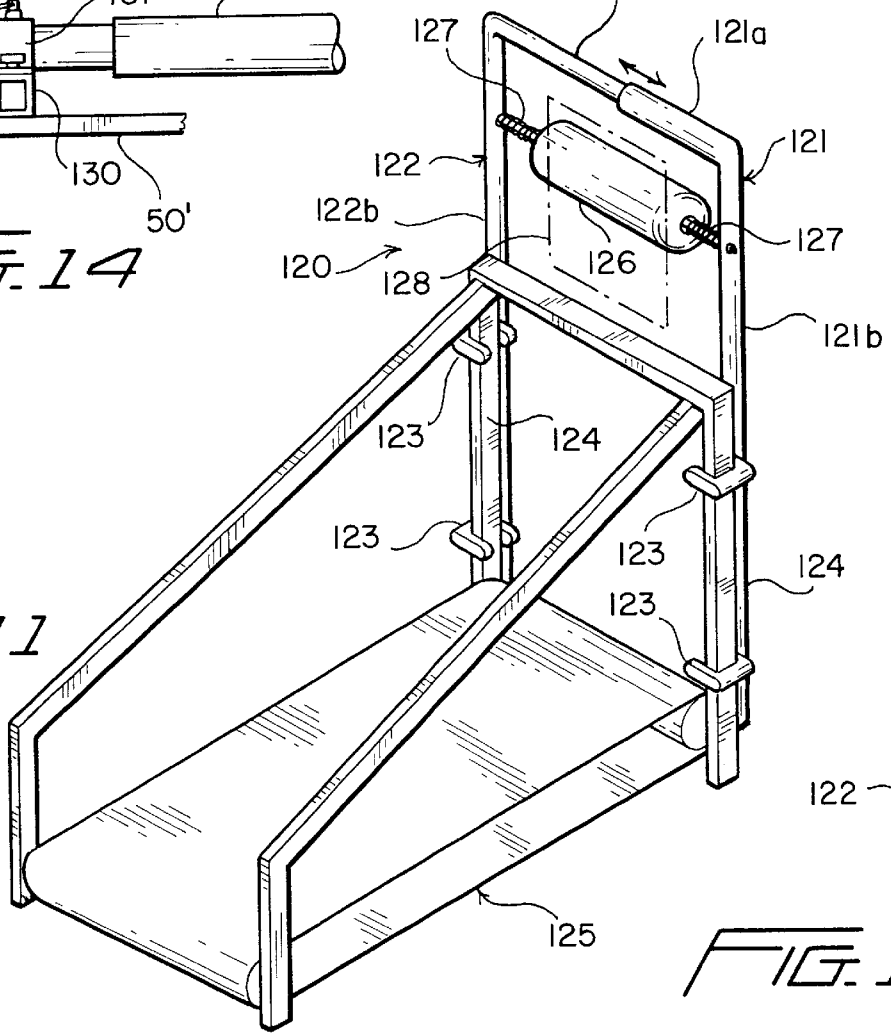
FIG. 11 is a top perspective view of a second form of the invention, shown attached to a conventional treadmill.

One or more clamps 123 are attached to the depending legs 121*b,* 122*b* of the U-shaped frame to secure the frame to the uprights 124 of a treadmill 125. As shown in FIG. 11, an elongate, generally hot-dog-shaped punching bag 126 is suspended between the legs 121*b,* 122*b,* preferably by use of resilient means 127, in position to be accessible for striking by a person using the treadmill.

In lieu of the elongate punching bag 126, a differently shaped punching bag may be used, such as the rectangular bag 128 shown in dot-and-dash lines in FIG. 11.

Alternatively, a speed bag 51 suspended from a board 50' may be attached to the frame in lieu of the bags 126 or 128. In this embodiment, the board 50' is mounted to a frame member 130 which, in turn, is assembled to a bracket 131 that is releasably attached to the frame member 122*a* by a fastener 132. The bracket 131, in turn, may be releasably attached to the frame member 130 by fasteners 133. It will be noted that the fastener 132 extends into an opening in the frame 122*a,* thereby preventing the bracket 131 from rotating around or sliding axially along the member 122*a*.

The width of the apparatus 120 may be quickly and easily adjusted by simply sliding the horizontal members 121*a* and 122*a* toward or away from one another, and the vertical position of the punching bag 126 may be adjusted by positioning the clamps 123 in desired positions along the treadmill uprights 124. Thus, the apparatus 120 may be quickly and easily adapted to different treadmills, and the position of the punching bag may be quickly and easily adjusted for optimum use by different individuals.

With the arrangements thus described, the exercise apparatus may be associated with a conventional treadmill, such as that shown in FIG. 11, for example, and a selected one of the punching devices positioned so that it may be struck by a person using the treadmill. The punching device may be adjusted both vertically and horizontally to optimally position it for use. If desired, the punching device not in use by the person exercising on the treadmill may be positioned so that it can be struck by a second person. See FIGS. 1, 5 and 7, for example.

The apparatus of the invention is simple and rugged in construction, and has great versatility in that it (at least that form shown in FIGS. 1–10) may be used alone as a boxing exercise device, or in combination with a conventional treadmill to simultaneously provide multiple forms of exercise, and may even be used simultaneously by more than one person. The form of the invention shown in FIGS. 11–14 makes use of the frame of an existing exercise device, and is therefore much more simple and economical than conventional boxing exercise devices, in addition to which it enables multiple exercises to be simultaneously performed on a treadmill.

While particular embodiments of the invention have been illustrated and described in detail herein, it should be understood that various changes and modifications may be made to the invention without departing from the spirit and intent of the invention as defined by the scope of the appended claims.

What is claimed is:

1. In combination, boxing exercise apparatus and a treadmill, comprising:

an adjustable frame having support means for selectively adjustably supporting different types of punching bags in optimum position to be struck with the hands and/or feet of a person using the apparatus;

at least one punching bag supported on the frame by the support means;

adjustable attaching means on the frame for releasably attaching the boxing exercise apparatus to a treadmill for simultaneous use of the boxing exercise apparatus and the treadmill, said frame being adjustable in multiple directions to accommodate proper positioning of the adjustable attaching means; and a treadmill connected with the attaching means in position for simultaneous use of the punching bag and the treadmill.

2. Boxing exercise apparatus as claimed in claim 1, wherein:

the frame is free-standing, whereby it can be used to support a punching bag independently of use with a treadmill.

3. Boxing exercise apparatus as claimed in claim 1, wherein:

the frame is not free-standing and is mounted for support on the frame of a treadmill.

4. Boxing exercise apparatus as claimed in claim 1, wherein:

means are on the frame for simultaneously supporting multiple punching bags in position for use.

5. Boxing exercise apparatus as claimed in claim 1, wherein:

releasable means is on the frame for selectively supporting different types of punching bags in position for use.

6. Boxing exercise apparatus as claimed in claim 2, wherein:

the frame includes a central section, laterally adjustable side assemblies connected thereto on opposite sides thereof, and a vertically adjustable superstructure, said central section and said side assemblies defining a support for stably supporting the frame on a surface, and said superstructure defining a support for holding a punching bag in optimum position to be struck by a person using the apparatus.

7. Boxing exercise apparatus as claimed in claim 6, wherein:

the attaching means is carried on the adjustable side assemblies of the frame, whereby the lateral distance between the attaching means may be adjusted by laterally adjusting the side assemblies.

8. Boxing exercise apparatus as claimed in claim 7, wherein:

the attaching means is vertically adjustable on the side assemblies whereby the height of the attaching means may be adjusted.

9. Boxing exercise apparatus as claimed in claim 6, wherein:

the superstructure includes a vertically adjustable vertical member having an upper end, and a horizontally adjustable horizontal member mounted on the upper end of the vertical member; and means is on the horizontal member for supporting a punching bag in spaced relationship to the vertical member.

10. Boxing exercise apparatus as claimed in claim 1, wherein:

the frame includes a vertically adjustable vertical member having an upper end, and a horizontally adjustable horizontal member mounted on the upper end of the vertical member; and means is on the horizontal member for supporting a punching bag in spaced relationship to the vertical member.

11. Boxing exercise apparatus as claimed in claim 10, wherein:

shock absorber means is interposed between the vertical member and the horizontal member of the frame to absorb stresses imposed by striking the punching bag.

12. Boxing exercise apparatus as claimed in claim 10, wherein:

a bracket sleeve is mounted on the upper end of the vertical member, and the horizontal member is telescopically slidable therein to different horizontally adjusted positions.

13. Boxing exercise apparatus as claimed in claim 12, wherein:

a multi-purpose bracket is vertically slidable on the vertical member, below the bracket sleeve, and has at least one sleeve formed thereon for supporting an accessory member in addition to the punching bag that may be supported from the horizontal member.

14. Boxing exercise apparatus as claimed in claim 13, wherein:

the multi-purpose bracket has two sleeves with their respective longitudinal axes orthogonally disposed relative to one another.

15. Boxing exercise apparatus as claimed in claim 3, wherein:

the frame comprises a pair of L-shaped members each having a horizontal component and a vertical component, said horizontal components being telescopically interengaged with one another to define an inverted U-shaped frame with the vertical components extending in parallel, spaced relation to one another; and releasable attaching means is on said vertical components to attach the frame to uprights of a treadmill for support of the frame in an upright position.

16. Boxing exercise apparatus as claimed in claim 15, wherein:

the attaching means comprises clamps.

17. Boxing exercise apparatus, comprising:

an adjustable frame having means for selectively adjustably supporting different types of punching bags in optimum position to be struck with the hands and/or feet of a person using the apparatus;

adjustable attaching means on the frame for releasably attaching the boxing exercise apparatus to a treadmill for simultaneous use of the boxing exercise apparatus and the treadmill;

said frame being free-standing, whereby it can be used to support a punching bag independently of use with a treadmill, and including a central section, laterally adjustable side assemblies connected thereto on opposite sides thereof, and a vertically adjustable superstructure, said central section and said side assemblies defining a support for stably supporting the frame on a surface, and said superstructure defining a support for holding a punching bag in optimum position to be struck by a person using the apparatus;

said attaching means being carried on the adjustable side assemblies of the frame, whereby the lateral distance between the attaching means may be adjusted by laterally adjusting the side assemblies; and the attaching means is vertically adjustable on the side assemblies, whereby the height of the attaching means may be adjusted.

18. Boxing exercise apparatus, comprising:

an adjustable frame having means for selectively adjustably supporting different types of punching bags in optimum position to be struck with the hands and/or feet of a person using the apparatus;

adjustable attaching means on the frame for releasably attaching the boxing exercise apparatus to a treadmill for simultaneous use of the boxing exercise apparatus and the treadmill;

said frame including a vertically adjustable vertical member having an upper end, and a horizontally adjustable horizontal member mounted on the upper end of the vertical member;

means on the horizontal member for supporting a punching bag in spaced relationship to the vertical member; and shock absorber means interposed between the vertical member and the horizontal member of the frame to absorb stresses imposed by striking the punching bag.

19. Boxing exercise apparatus, comprising:

an adjustable frame having means for selectively adjustably supporting different types of punching bags in optimum position to be struck with the hands and/or feet of a person using the apparatus;

adjustable attaching means on the frame for releasably attaching the boxing exercise apparatus to a treadmill for simultaneous use of the boxing exercise apparatus and the treadmill;

said frame including a vertically adjustable vertical member having an upper end, and a horizontally adjustable horizontal member mounted on the upper end of the vertical member;

means on the horizontal member for supporting a punching bag in spaced relationship to the vertical member; and a bracket sleeve is mounted on the upper end of the vertical member, and the horizontal member is telescopically slidable therein to different horizontally adjusted positions.

20. Boxing exercise apparatus, comprising:

an adjustable frame having means for selectively adjustably supporting different types of punching bags in optimum position to be struck with the hands and/or feet of a person using the apparatus;

adjustable attaching means on the frame for releasably attaching the boxing exercise apparatus to a treadmill for simultaneous use of the boxing exercise apparatus and the treadmill, said frame being incapable of free-standing support;

said frame comprising a pair of L-shaped members each having a horizontal component and a vertical component, said horizontal components being telescopically interengaged with one another to define an inverted U-shaped frame with the vertical components extending in parallel, spaced relation to one another; and releasable attaching means on said vertical components to attach the frame to uprights of a treadmill for support of the frame in an upright position.

* * * * *